US009624589B2

(12) United States Patent
Rosenthal et al.

(10) Patent No.: US 9,624,589 B2
(45) Date of Patent: Apr. 18, 2017

(54) SYSTEM AND PROCESS FOR ELECTROCHEMICAL CONVERSION OF CARBON DIOXIDE TO CARBON MONOXIDE

(71) Applicants: Joel Rosenthal, Newark, DE (US); John L. DiMeglio, Newark, DE (US); Jonnathan Medina-Ramos, Newark, DE (US)

(72) Inventors: Joel Rosenthal, Newark, DE (US); John L. DiMeglio, Newark, DE (US); Jonnathan Medina-Ramos, Newark, DE (US)

(73) Assignee: UNIVERSITY OF DELAWARE, Newark, DE (US)

( * ) Notice: Subject to any disclaimer, the term of this patent is extended or adjusted under 35 U.S.C. 154(b) by 288 days.

(21) Appl. No.: 14/199,416

(22) Filed: Mar. 6, 2014

(65) Prior Publication Data

US 2014/0262792 A1 Sep. 18, 2014

Related U.S. Application Data

(60) Provisional application No. 61/779,666, filed on Mar. 13, 2013.

(51) Int. Cl.
*C25B 1/00* (2006.01)
*C25B 11/04* (2006.01)

(52) U.S. Cl.
CPC ..... *C25B 11/0447* (2013.01); *C25B 1/00* (2013.01)

(58) Field of Classification Search
CPC ..... C25B 1/00; C25B 11/0447; Y02P 20/121
See application file for complete search history.

(56) References Cited

U.S. PATENT DOCUMENTS 3,109,795 A * 11/1963 Gordon ..... C25B 1/00 205/412
6,103,088 A * 8/2000 Guhl ..... C01G 29/00 204/DIG. 13
7,858,379 B2 12/2010 Vaidya et al.
2011/0042203 A1 2/2011 McAlister
2011/0114502 A1 5/2011 Cole et al.
2011/0253551 A1 10/2011 Lane et al.
2012/0228146 A1 9/2012 Deguchi et al.

FOREIGN PATENT DOCUMENTS

WO WO 2012/177952 A1 12/2012

OTHER PUBLICATIONS

International Search Report and Written Opinion Issued for Application No. PCT/US2014/021563 Completed May 30, 2014 and Mailed Jun. 24, 2014.

* cited by examiner

*Primary Examiner* — Arun S Phasge
(74) *Attorney, Agent, or Firm* — RatnerPrestia

(57) ABSTRACT

The invention provides a system and a process that allow for the selective electrochemical conversion of carbon dioxide to carbon monoxide with high energy efficiency, using a cathode comprised of bismuth in combination with an anode such as an anode comprised of platinum. The electrolysis system may be comprised of a single or two compartment cell and may employ an organic electrolyte or an ionic liquid electrolyte. The invention permits the storage of solar, wind or conventional electric energy by converting carbon dioxide to carbon monoxide and liquid fuels.

11 Claims, 7 Drawing Sheets

SYSTEM AND PROCESS FOR ELECTROCHEMICAL CONVERSION OF CARBON DIOXIDE TO CARBON MONOXIDE

CROSS-REFERENCE TO RELATED APPLICATIONS

This application claims priority from U.S. provisional application No. 61/779,666, filed Mar. 13, 2013, the disclosure of which is incorporated herein by reference in its entirety for all purposes.

FEDERAL FUNDING

This invention was made with government support under Grant No. P20-RR017716 awarded by the National Institutes of Health (NIH). The government has certain rights in the invention.

FIELD OF THE INVENTION

The present invention pertains to systems and processes useful for the electrochemical conversion of carbon dioxide to carbon monoxide.

BACKGROUND OF THE INVENTION

Storage of solar and other sources of renewable electricity may be enabled by the endothermic production of chemical fuels such as $H_2$ or reduced carbon-containing compounds via the electrochemical reduction of $H_2O$ or $CO_2$, respectively. In particular, the renewable production of liquid fuels provides a clear route to energy supply and distribution and addresses energy needs associated with transportation, which account for more than 20% of US energy demand. Moreover, liquid fuels are compatible with existing infrastructure for energy supply and distribution. The societal importance and economic value of liquid fuel resources clearly highlights the need for new platforms that enable the sustainable generation of liquid fuels from $CO_2$, and distinguishes $CO_2$ activation and reduction chemistry as a critical area of focus in the fields of renewable energy storage and molecular energy conversion.

An attractive strategy for the synthesis of carbon-based fuels using renewable energy is the marriage of a robust electrocatalyst for $CO_2$ reduction with a photoelectrochemical (PEC) device or a conventional electrolyzer powered by a renewable source of electrical current. Several $CO_2$ reduction products can be targeted via the half reactions shown in equations 1-3. For instance, the direct electrochemical reduction of $CO_2$ to methane or methanol (Eq. 1 and 2) are attractive energy storing reactions, however, the kinetic hurdles associated with these multielectron proton-coupled electron transfer (PCET) reactions are large, which significantly complicates such processes. By contrast, the $2e^-/2H^+$ reduction of $CO_2$ to carbon monoxide (Eq. 3) is another energetically uphill half reaction that delivers a versatile and energy rich commodity chemical. In addition to being useful for the industrial production of methanol, acetic acid and some plastics, CO can be reacted with $H_2O$ via the water-gas shift (WGS) reaction to generate $H_2$. This $CO/H_2$ mixture (synthesis gas) can be used to generate synthetic petroleum and liquid fuels using existing Fischer-Tropsch (FT) methods for direct integration into existing energy storage and distribution networks.

Much effort has been devoted to the heterogeneous reduction of $CO_2$ at metallic electrodes with the goal of driving selective formation of CO via Eq. 3. The majority of such studies have been carried out using aqueous electrolytes with tightly controlled pH requirements (pH ~8.5-10.5). Under aqueous conditions, the standard potentials for the two electron reduction of $CO_2$ to CO is only 0.12 V more negative versus RHE (the reversible hydrogen electrode) than the competing two electron reduction of protons to $H_2$ (Eq. 3 and 4). As such, for the rate of $CO_2$ reduction to outcompete hydrogen evolution at the cathode, the proton availability of the aqueous electrolyte must be minimized. This has historically been accomplished by using concentrated aqueous carbonate or bicarbonate electrolytes. Under such conditions, there are a handful of cathode materials that can drive the conversion of $CO_2$ to CO. However, only noble metals such as Ag and Au have been shown to catalyze this electrochemical reaction with Faradaic Efficiencies (FEs) that are in excess of 80% at ambient pressures. The implementation of Ag and Au cathodes for electrochemical production of CO has been hampered by two distinct factors. Firstly, the exorbitant cost of these noble metals eliminates their practical use on the scale required for alternative fuel synthesis. The second issue concerns the limited current densities associated with CO production at Ag and Au electrodes, which is directly linked to the kinetics of $CO_2$ electrocatalysis at these platforms.

$$CO_2+8H^++8e^-\rightarrow CH_4+2H_2O\ E^o=-0.12\text{ V vs. RHE} \quad \text{(Eq. 1)}$$

$$CO_2+6H^++6e^-\rightarrow CH_3OH+H_2O\ E^o=-0.12\text{ V vs. RHE} \quad \text{(Eq. 2)}$$

$$CO_2+2H^++2e^-\rightarrow CO+H_2O\ E^o=-0.12\text{ V vs. RHE} \quad \text{(Eq. 3)}$$

$$2H^++2e^-\rightarrow H_2\ E^o=0\text{ V vs. RHE} \quad \text{(Eq. 4)}$$

These limited current densities are a direct consequence of the required basic electrolyte solutions for which the solubility of dissolved $CO_2$ is very low. Several strategies have been employed to combat the inherently low concentration of $CO_2$ at high pH. These include utilization of 3-dimensional and gas diffusion electrodes, elevation of $CO_2$ pressure in the electrolysis cell and use of additives such as ionic liquids (ILs) or organic solvents, which can dramatically improve the solubility of $CO_2$ in the electrolyte solution. Various metal electrodes have been studied for $CO_2$ reduction activity in non-protic solvents, which display excellent $CO_2$ solubility at ambient pressure, such as acetonitrile (MeCN) and dimethylformamide (DMF). Although the hydrogen evolution reaction is highly suppressed under these conditions, the electrochemical reduction of $CO_2$ in organic electrolytes often leads to product mixtures that can include formate, oxalate and glyoxalate in addition to CO. As a result, there are few materials that can catalyze the electrochemical conversion of $CO_2$ to CO in organic catholyte with even modest FEs. Moreover, the few metals that can drive this electrocatalytic process with reasonable current densities do so only upon application of very large overpotentials. The dearth of cost effective systems that can efficiently and selectively drive Eq. 3 highlights the need for new electrode/electrolyte pairings that can promote the electrocatalytic conversion of $CO_2$ to CO at appreciable rate (high current density) and with high Faradaic and energy efficiencies.

Carbon monoxide is a valuable commodity chemical that is required for the production of many other products, including plastics, solvents and acids. It can also be used directly to prepare other valuable reagents such as hydrogen via the industrial Water-Gas-Shift process. Also, carbon monoxide is the principal feedstock for the industrial Fischer-Tropsch process, which allows for the large-scale production of synthetic petroleum.

Carbon dioxide is also a waste product from conventional power plants. Collection and sequestration of carbon dioxide is commonplace. The ability to convert this waste product to a commodity chemical such as carbon monoxide can offset the cost of sequestration and is of interest to current power producers. Moreover, an attractive strategy for storage of renewable energy resources such as solar or wind is electrochemical fuel synthesis from carbon dioxide. This technology has not yet been realized commercially due to the lack of electrode systems capable of driving the conversion of carbon dioxide to fuels or fuel precursors. Thus, it would be advantageous to develop technology which bridges this gap by allowing electricity from a photovoltaic assembly, wind turbine, etc. to be used to drive fuel production.

Another desirable development would be technology that provides the ability to generate carbon monoxide directly from carbon dioxide on a small scale. Carbon monoxide is required for commodity chemical synthesis, which includes some pharmaceuticals and other species that require carbonylation and hydroformylation chemistry. Since carbon monoxide is an expensive and toxic feedstock, the ability to generate small quantities of this chemical on demand allows it to be prepared as needed as opposed to relying on large stockpiles of carbon monoxide produced using conventional methods. This strategy would also reduce costs associated with safety and carbon monoxide use.

The present invention addresses the above-mentioned objectives, among others.

SUMMARY OF THE INVENTION

The present invention will permit the production of carbon monoxide, which is a valuable commodity chemical and fuel precursor, from atmospheric carbon dioxide, flue gas from a power plant and/or other $CO_2$ streams. Since this energy storing process is driven electrochemically, the invention allows carbon monoxide production to be driven using conventional electric and/or renewable energy resources such as wind or solar. Taken together, this invention will permit storage of solar, wind or conventional electric by converting carbon dioxide to carbon monoxide and liquid fuels.

One aspect of the invention provides an electrolytic system for conversion of carbon dioxide to carbon monoxide, the system comprising an electrode comprised of bismuth and a source of electrical current in electrical communication with the electrode. The electrode comprised of bismuth may be a cathode and the system may further comprise an anode such as an anode comprised of platinum and an electrolyte in fluid communication with at least one of the cathode comprised of bismuth or the anode. The cathode may be in fluid communication with a first electrolyte, the anode may be in fluid communication with a second electrolyte, and the first electrolyte and the second electrolyte may be the same as or different from each other.

Another aspect of the invention provides an electrolytic system for conversion of carbon dioxide to carbon monoxide, wherein the system comprises a cathode comprised of bismuth, an anode comprised of platinum (or other suitable anode material such as an iridium oxide, ruthenium oxide, iron oxide, cobalt oxide, nickel oxide and/or mixed metal oxide), an electrolyte (e.g., an ionic liquid or an organic electrolyte) in fluid communication with at least one of the cathode and the anode, and a source of electrical current in electrical communication with the cathode and the anode. In one embodiment, the cathode and the anode are present in a single compartment. In another embodiment, the cathode is present in a first compartment, the anode is present in a second compartment, and the first and second compartment are separated by an ion conducting bridge such as a porous glass frit or polymeric membrane. In such an embodiment, the cathode may be in fluid communication with a first electrolyte, the anode may be in fluid communication with a second electrolyte, and the first electrolyte and the second electrolyte may be the same as or different from each other.

Another aspect of the invention further provides an electrolyte which is an ionic liquid that may comprise one or more of borate ions, phosphate ions, imidazolium ions, pyridinium ions, pyrrolidinium ions, ammonium ions, phosphonium ions, halides, triflates, tosylates, bistriflimides and combinations thereof. The electrolyte may also be an organic liquid comprising one or more of acetonitrile, dimethylformamide, dimethyl sulfoxide, a carbonate, and combinations thereof.

Yet another aspect of the invention provides a method for electrochemically converting carbon dioxide to carbon monoxide, wherein the method comprises electrolyzing carbon dioxide in an electrolytic system comprising an electrode comprised of bismuth and a source of electrical current in electrical communication with the electrode. The electrolytic system may further comprise an anode (such as an anode comprised of platinum), an electrolyte in fluid communication with at least one of the cathode and the anode, and a source of electrical current in electrical communication with the cathode and the anode, whereby carbon dioxide may be continuously introduced into the electrolytic system.

Yet another aspect of the invention provides a method of making an electrode comprised of bismuth, wherein the method comprises electrodepositing a bismuth containing material onto a surface of an inert electrode substrate and wherein the method may further comprise reducing a solution comprising a precursor to the bismuth containing material. The inert electrode substrate may be a glassy carbon, graphite, carbon fiber, carbon paper, carbon cloth or metallic electrode, for example. In yet another aspect, the invention provides an electrode comprised of bismuth.

These and other features of the present invention will be described in more detail below in the detailed description of the invention and in conjunction with the following figures.

DESCRIPTION OF THE FIGURES

The present invention is illustrated by way of example, and not by way of limitation, in the figures of the accompanying drawings and in which.

DETAILED DESCRIPTION OF THE INVENTION

Figure 1A:
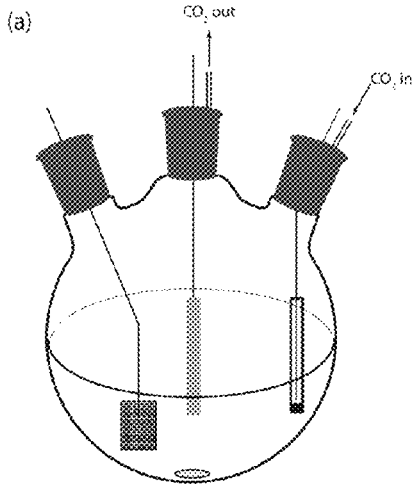
FIG. 1*a* shows a single cell arrangement of an electrolytic system and FIG. 1*b* shows a dual cell arrangement of an electrolytic system.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Bismuth represents an attractive material for development of heterogeneous $CO_2$ reduction catalysts, as this metal is largely non-toxic and has a very small environmental impact. Moreover, Bi is a byproduct of lead, copper and tin refining, and has few significant commercial applications, resulting in the price of Bi being low and stable. Moreover, the ability of Bi to drive electrochemical conversion of $CO_2$ to CO would represent an important development in the fields of $CO_2$ electrocatalysis and renewable energy conversion.

Cathodes useful in the present invention are electrodes containing metallic bismuth ($Bi^0$ or metastable materials such as $Bi_2O_3$ that can be converted to $Bi^0$ during electrolysis. The cathode may, for example, be a bismuth modified electrode wherein a $Bi^0$ and/or $Bi^{3+}$ containing film(s) has been deposited on a substrate, such as a carbon-based substrate. The bismuth film may be deposited electrochemically or via other chemical means including electroless plating, sputtering, CVD (Chemical Vapor Deposition), ALD (Atomic Layer Deposition), etc. Bismuth bulk electrodes may also be utilized.

In one aspect of the invention, an electrode comprised of bismuth is prepared by electrodepositing bismuth on an inert electrode substrate via the reduction of a solution of a bismuth (III) compound (which functions as a precursor to the bismuth film formed on the surface of the inert electrode substrate). The solution may be an aqueous solution, an organic solution, or a mixed aqueous/organic solution. A polar organic solvent such as acetonitrile or the like may be used to prepare the organic solution. The organic solution may additionally comprise a 1,3-disubstituted imidazolium salt such as a chloride, bromide, tetrafluoroborate, hexafluorophosphate, or triflate salt of a 1,3-dialkylimidazolium such as 1-butyl-3-methylimidazolium (BMIM). Where an aqueous solution is employed, the aqueous solution may additionally comprise a salt such as KBr and/or an acid such as HCl. In one embodiment, the bismuth compound is an inorganic bismuth compound such as bismuth nitrate. In another embodiment, the bismuth (III) compound is an organobismuth compound such as $Bi(OTf)_3$. Electrodeposition may be carried out using controlled potential electrolysis (CPE).

Anodes useful in the present invention are electrodes comprised of platinum or metal oxide based materials, such as iridium oxides, ruthenium oxides, iron oxides, cobalt oxides, nickel oxides, and the like (including mixed metal oxides). The platinum may, for example, be in the form of platinum black. Platinum black (Pt black) is a fine powder of platinum with good catalytic properties. Platinized anodes, wherein an electrode substrate (such as a carbon substrate or metallic substrate, such as a platinum or titanium substrate, which could be in the form of a mesh or screen) is covered with a thin film of platinum black are particularly useful. In common practice, the platinum black is either sprayed or hot pressed onto the substrate. A suspension of platinum black and carbon powder in an aqueous solution may, for example, be applied to the substrate surface. Electrodeposition (electroplating) techniques may also be employed to provide a platinized anode.

The working electrodes employed for the electrolytic system of the invention may, for example, include either a bismuth plate, a piece of bismuth foil or a bismuth modified electrode as the cathode and a platinized mesh as the anode. Bismuth plates may be preconditioned, for example by polishing with a slurry of 0.05 micron alumina powder in water. Residual alumina may be rinsed from the bismuth surface with Millipore water, and the plate then sonicated in Millipore water for five minutes prior to use. Bismuth modified cathodes may be prepared, for example, by submersing any conducting support such as glassy carbon, carbon paper or a piece of metal in an acidic solution containing any water soluble bismuth (III) salt such as bismuth (III) nitrate (0.5 to 40 mM), protic acid such as hydrochloric acid (0.2 to 2 M) and a salt such as KBr (0.1 to 1 M). The conducting substrate may then be preconditioned by cycling the applied potential (10 cycles) from 0 to −0.55 V vs. SCE at a sweep rate of 100 mV/sec. Controlled potential electrolysis at −0.21 V vs SCE may be carried out on the quiescent solution to form a bismuth modified electrode, which may then be sequentially rinsed with 1 M hydrochloric acid, Millipore water, and acetonitrile prior to being dried under a gentle stream of nitrogen.

Bismuth modified cathodes may also be prepared, for example, by submersing any conducting support such as glassy carbon, carbon paper or a piece of metal in an organic solvent containing an appropriate organic soluble bismuth (III) salt such as bismuth (III) triflate (0.5 to 40 mM). Controlled potential electrolysis at potentials more negative than −1.2 V vs SCE may be carried out on the quiescent or stirred solution to form the bismuth modified electrode, which may then be rinsed with an organic solvent prior to being dried under a gentle stream of nitrogen.

Figure 1B:
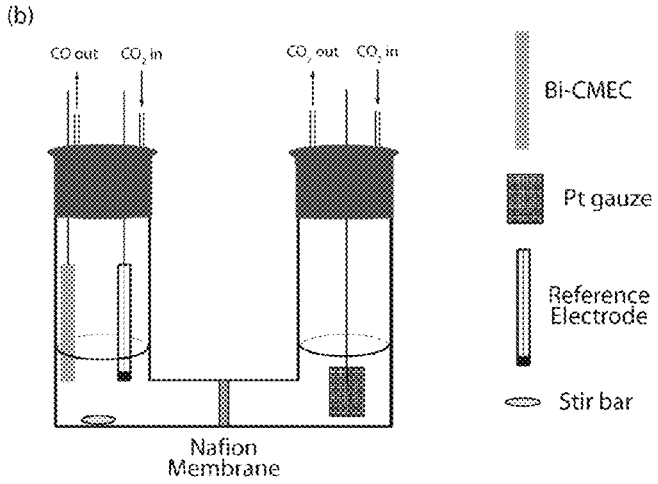

The electrolysis device of the invention can be comprised of either a single or two-compartment cell configuration, as shown in FIGS. 1*a* and 1*b*, respectively. For the single-compartment cell configuration, the cathode, anode and reference electrodes are all immersed in a single housing containing an electrolyte solution. The two-compartment cell configuration incorporates an ion conducting bridge such as a glass or Nafion® membrane, which separates the cathode from the anode and is generally more efficient for carbon monoxide electrosynthesis. The ion conducting bridge may be configured to be liquid permeable but to substantially prevent gas flow or transport from the cathode side of the ion conducting bridge to the anode side of the ion conducting bridge and vice versa, including substantially preventing the flow of gas dissolved in the electrolyte or after nucleation of gas bubbles. Generalized schematics for the single and two-compartment cell electrolyzers are shown in FIGS. 1*a* and 1*b*. A reference electrode (e.g., a Ag/AgCl reference electrode) may be present. The electrolytic cell may be configured to be pressurized, to permit the desired electrolysis of carbon dioxide to yield carbon monoxide to proceed at a pressure above atmospheric pressure.

The electrolyzer may be filled with an electrolyte solution that is comprised as follows. Acetonitrile or a similar organic solvent containing 0.05-0.2 M of a tetraalkylammonium salt such as tetrabutylammonium hexafluorophosphate and 10-300 mM of any imidazolium based ionic liquid (IL) additive such as the hexafluorophosphate (or tetrafluoroborate, chloride, bromide, acetate, and/or triflate) salt of a 1,3-disubstituted imidazolium. The 1,3-disubstituted imidazolium may be an imidazolium that is substituted at the 1 and 3 positions with substituents (which may be the same as or different from each other) selected from the group consisting of alkyl groups (e.g., C1-C8 alkyl groups including methyl, ethyl, propyl, butyl, octyl and isomers thereof), aryl groups and halogenated derivatives thereof. The 2 position of the imidazolium may be similarly substituted, as in 1-butyl-2,3-dimethylimidazolium (BMMIM). The heterocyclic ring of the imidazolium may be substituted with one or more halogens. Illustrative suitable imidazolium species include 1-ethyl-3-methylimidazolium (EMIM), 1-butyl-3-methylimidazolium (BMIM), 1,3-dimethylimidazolium, 1-methyl-3-propylimidazolium, or any other 1,3-dialkyl or 1,3-diaryl substituted imidazolium. Alternatively, acetonitrile (or a similar organic solvent) containing 0.05-0.2 M tetrabutylammonium hexafluorophosphate ($TBAPF_6$) or other such tetraalkylammonium salt and 10-300 mM of a fluorinated alcohol such as 2-fluoroethanol, 2,2-difluoroethanol, 2,2,2-trifluoroethanol, 1,1,1-trifluoro-2-propanol, 1,1,1,3,3,3-hexafluoro-2-propanol, 2-trifluoromethyl-2-propanol, hexafluoro-2-methylisopropanol, and nonafluoro-tert-butanol can also be used as the additive. In all cases, dimethylformamide, dimethyl sulfoxide, carbonates (e.g., propylene carbonate, ethylene carbonate, dialkyl carbonate), dimethyl sulfone, sulfolane, gamma butyrolactone, nitriles such as propionitrile and butyronitrile, or esters such as methyl acetate and other polar organic solvents can be substituted for acetonitrile. Observed current densities and efficiencies are typically optimal in acetonitrile, however. If an ionic liquid additive is employed, the tetraalkyl ammonium salt can be excluded from the electrolytic cell.

The present invention may also be practiced using a pure ionic liquid as the electrolyte. Under these conditions, acetonitrile (or another polar organic solvent) and an ammonium salt are unnecessary. Imidazolium-based ionic liquids containing tetrafluoroborate, hexafluorophosphate, acetate and/or triflate counter-anions are all effective electrolytes in this regard and provide faradaic efficiencies for carbon monoxide production of 80-90%. Suitable ionic liquids may, for example, generally consist of bulky and asymmetric organic cations such as imidazolium cations (e.g., 1-alkyl-3-methylimidazolium), pyridinium cations (e.g., 1-alkylpyridinium cations), pyrrolidinium cations (e.g., N-methyl-N-alkylpyrrolidinium cations) and ammonium ions (e.g., tetraalkylammonium ions). The cation may also be a phosphonium cation. A wide range of anions may be employed, ranging from simple halides and inorganic anions such as tetrafluoroborate and hexafluorophosphate, to large organic anions like bistriflimide, triflate or tosylate.

Upon sealing the electrolysis device with septa, stoppers or other suitable connections, the solution and head space may be sparged with carbon dioxide at 1 atm for approximately 20 minutes, after which time the electrolysis is initiated by poising the bismuth cathode at potentials more negative than −1.85 V versus SCE. Generation of CO is monitored by either manual injection or direct flow into a gas chromatograph. On a commercial scale, CO can be separated from the headspace using a standard gas diffusion electrode or other gas sorption/separation technology.

A source of electrical current is in electrical communication with the cathode and the anode. The power source may implement a variable voltage source. The source of electrical current may be operational to generate an electrical potential between the anode and the cathode. The electrical potential may be a DC voltage.

The electrolytic system of the present invention may comprise a carbon dioxide source. The carbon dioxide source is generally operational to provide carbon dioxide (as a gas, for example) to a cell comprising the cathode, anode and electrolyte, which may be comprised of one, two or more compartments (chambers). In certain embodiments of the invention, the carbon dioxide is bubbled or sparged directly into the compartment containing the cathode.

The electrolysis can be carried out either under isolation or under a steady flow of carbon dioxide. Under the latter conditions, current densities for CO production are measured to be roughly as high as 30 $mA/cm^2$, at an applied potential that is less negative than −2.1 V vs. SCE, which is comparable to or better than existing technologies. The electrochemical system of the invention has been found to be robust and is capable of demonstrating steady current densities for longer than 8-10 hours. The faradaic efficiency for CO formation using the present invention may be approximately 85-95% and the energy efficiency for carbon dioxide reduction may be approximately 75-85%. When taken together, the stability as well as the faradic and energy efficiencies are superior to previously known electrolytic systems that utilize inexpensive cathode materials.

EXAMPLE 1

Figure 2A:
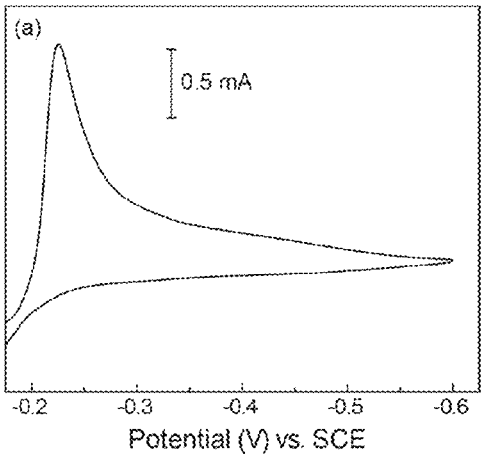
FIG. 2*a* shows a cyclic voltammogram (CV) for a bismuth modified glassy carbon electrode (GCE) in a solution of 1 M HCl and 0.5 M KBr containing 20 mM $Bi^{3+}$

A Bi containing material was electrodeposited onto an inert electrode substrate via the reduction of an aqueous solution of 20 mM $Bi(NO_3)_3$ containing 0.5 M KBr and 1.0 M HCl using a glassy carbon electrode (GCE) to produce the CV trace shown in FIG. 2*a*, which is characterized by a broad reduction cathodic wave. Controlled potential electrolysis (CPE) was carried out at −0.21 V versus the standard calomel electrode (SCE; all potentials are referenced to this electrode) for quiescent acidic $Bi^{3+}$ solutions until ~0.2-2.8 $C/cm^2$ had been passed, leading to electrodeposition of a grey, non-lustrous material on the GCE surface. Glassy carbon was used as the working electrode to ensure that the base conducting substrate supported negligible background activity for $CO_2$ reduction.

Figure 2B:
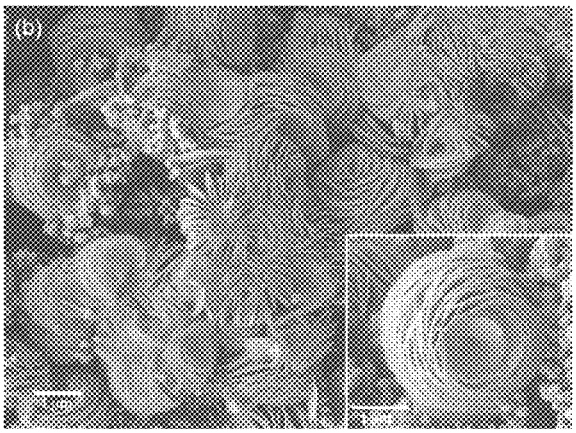
FIG. 2*b* shows an SEM image of the bismuth modified glassy carbon electrode.

The morphology of the deposited material was examined by scanning electron microscopy (SEM). As shown in FIG. 2*b*, the electrode is coated by an array of striated clusters, interspersed within a film of smaller crystallites. Magnification of the micrometer sized clusters shows that the basic morphology of this material is reminiscent of a flower or rosebud. Energy-dispersive X-ray (EDX) analysis was performed on the electrodeposited material, and EDX spectra were obtained from multiple 40×40 $\mu m^2$ regions of several independently prepared samples. These spectra identify Bi, Br and Cl as the principal elemental components in a ratio of roughly 7:1:1 with trace amounts of O and K also present. Any signal for carbon present in the EDX spectra can be attributed to the underlying GCE on to which the Bi material was deposited. The surface of the electrodeposited material was also analyzed by x-ray photoelectron spectroscopy (XPS). All of the elements detected by EDX are also accounted for by XPS. High-resolution XPS spectra for the bismuth region reveal Bi 4f7/2 signals at 156.5 and 159.3 eV, which are in the range typical of $Bi^0$ and $Bi^{3+}$ ions. When taken together, the EDX and XPS analyses indicate that reduction of the $Bi^{3+}$ solutions in acidic KBr leads to deposition of a microcrystalline material containing metallic $Bi^0$ and $Bi^{3+}$ that has incorporated a significant amount of bromide and chloride along with traces of oxygen and potassium.

The electrochemical surface area of a Bi-modified electrode was determined via Randles-Sevcik analysis using potassium ferricyanide as a redox probe. This analysis yielded a roughness factor of ~1.3 compared to a bare GCE. Similarly, measurement of the double-layer capacitance produced a value of 63±5 mF/$cm^2$ for the Bi-modified electrode, reflecting the textured/porous morphology of the electrodeposited material.

EXAMPLE 2

A Bi containing material was electrodeposited onto an inert electrode substrate via the cathodic polarization of an acetonitrile solution containing 1 mM [$Bi(OTf)_3$] and 300 mM [BMIM]OTf. Controlled potential electrolysis (CPE) was carried out at −2.0 V versus the standard calomel electrode (SCE; all potentials are referenced to this electrode) until ~2.8 C/$cm^2$ had been passed, leading to electrodeposition of a dark, non-lustrous material on the GCE surface. Glassy carbon was used as the working electrode to ensure that the base conducting substrate supported negligible background activity for $CO_2$ reduction.

Figures 3A, 3B, 3C, 3D:
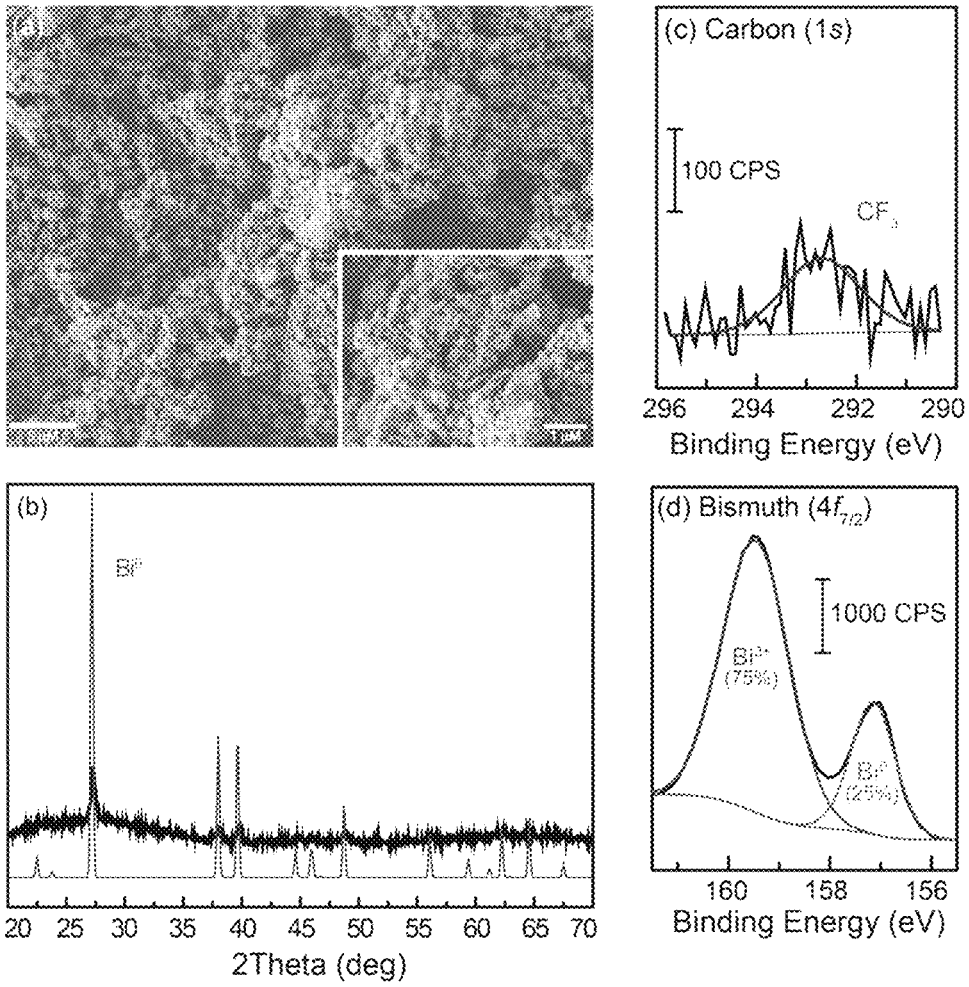
FIG. 3*a* shows SEM images of Bi catalyst electrodeposited on a GCE from MeCN (acetonitrile) containing 300 mM [BMIM]OTf (1-butyl-3-methylimidazolium trifluoromethanesulfonate) and 1.0 mM $[Bi(OTf)_3]$ (Bismuth (III) trifluoromethanesulfonate)
FIG. 3*b* shows the powder XRD (X-ray diffraction) pattern of this in-situ deposited Bi material.
FIGS. 3*c* and 3*d* show high-resolution XPS (X-ray photoelectron spectroscopy) spectra of the in-situ deposited Bi material.

The morphology and composition of the bismuth material deposited from organic electrolyte was probed by a combination of physical methods. Scanning electron microscopy (SEM) revealed that the electrodeposited material consists of submicrometer-sized particles that have coalesced into a film with a sponge-like morphology (FIG. 3*a*). The X-ray powder diffraction pattern obtained for this material is consistent with this amorphous morphology, largely showing broad features and only small peaks indicative of crystalline $Bi^0$ (FIG. 3*b*). In order to gain a greater understanding of the elemental composition of the in-situ generated Bi-containing material, energy-dispersive X-ray (EDX) analysis was performed on 40×40 $\mu m^2$ regions of several independently prepared samples of the electrodeposited catalyst. The surface of the material was also analyzed by X-ray photoelectron spectroscopy (XPS). All elements detected by EDX were also accounted for by XPS, which identified Bi, O, S and F as the principal elemental components and suggests that small amounts of triflate from the $Bi^{3+}$ precursor or ionic liquid are incorporated into the electrodeposited material. Consistent with this assignment are the high-resolution XPS spectra of the C 1s, F 1s, S 2s and O 1s regions (FIG. 3*c*). Integrating the small peak in the C 1s spectrum at 292.7 eV (corresponding to the carbon of a $CF_3$ group, such as that in triflate), the S 2s peak, the F 1s peak and a component for the lower binding energy peak in O 1s (530.1 eV), the ratio was found to be approximately 1:3:1:3 respectively. As such, the relative intensities of these components matches the ratio of C:F:S:O expected for a triflate anion. Moreover, XPS analysis of the electrodeposited bismuth reveals Bi $4f_{7/2}$ signals at 157.1 and 159.5 eV, which are values typically observed for $Bi^0$ and $Bi^{3+}$, respectively (FIG. 3*d*). Based on XPS analysis of the in-situ prepared Bi-CMEC material, the ratio of $Bi^0$ to $Bi^{3+}$ is ~1:3. Electrodeposition of both $Bi^0$ and $Bi^{3+}$ ions has been observed for Bi-CMEC films formed from concentrated acidic solutions. When taken together, the EDX and XPS analyses indicate that in-situ reduction of MeCN solutions of [Bi$(OTf)_3$] containing 300 mM [BMIM]OTf leads to deposition of a largely amorphous material containing metallic $Bi^0$ and $Bi^{3+}$ ions that has incorporated a significant amount of oxygen and a small amount of triflate.

EXAMPLE 3

Figure 4A:
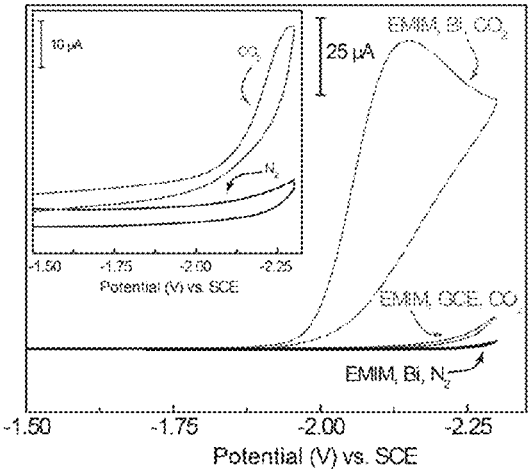
FIG. 4*a* shows CV traces recorded for Bi-modified and bare GCEs in MeCN containing 20 mM [EMIM]$BF_4$ (1-ethyl-3-methyl imidazolium tetrafluoroborate) with the inset showing Bi-modified GCE in MeCN without ionic liquid and FIG. 4*b* shows the representative total current density ($j_{tot}$) profiles for Bi-CMEC and GCE at −1.95 V in MeCN (acetonitrile), wherein the electrochemistry was performed using 0.1 M $TBAPF_6$ (tetrabutylammonium hexafluorophosphate) as electrolyte for the results of FIG. 4*a* and FIG. 4*b*.

The ability of the Bi-modified electrode to electrochemically activate $CO_2$ was assessed in MeCN, which supports a large electrochemical window and is commonly employed for $CO_2$ electrocatalysis. As shown in the inset of FIG. 4*a*, scanning to negative potentials in $CO_2$ saturated solutions of MeCN containing 0.1 M tetrabutylammonium hexafluorophosphate ($TBAPF_6$) shows a small current enhancement as compared to the corresponding experiment under $N_2$. 1,3-Dialkyl substituted imidazolium based ionic liquids (ILs) can strongly interact with $CO_2$ and have found application for carbon sequestration. Moreover, the ability of such ILs to bind reduced $CO_2$ intermediates at Ag electrodes and mediate electrochemical generation of CO at low overpotentials has also been demonstrated. With these properties in mind, the IL 1-ethyl-3-methylimidazolium tetrafluoroborate ([EMIM]$BF_4$) was added to the $CO_2$ saturated MeCN solution. The IL induced a dramatic change in the resultant I/V curves and led to large increases in current at potentials more negative than −1.9 V versus SCE. In particular, the onset of a large, irreversible cathodic wave at −1.85 V is indicative of an electrocatalytic process (FIG. 4*a*). This current response cannot simply be attributed to reduction of $[EMIM]^+$ at the electrode surface, as repeating the same CV experiment in the absence of $CO_2$ does not produce a

TABLE 1

Faradaic efficiencies (FE) and current densities for electrocatalytic reduction of $CO_2$ to CO at an applied potential of −1.95 V vs. SCE.

| Electrode | Ionic Liquid | Solvent | CO FE | $H_2$ FE | $j_{co}$ (mA/$cm^2$) |
|---|---|---|---|---|---|
| GCE | [EMIM]$BF_4$ | MeCN | Trace | Trace | <0.03[a] |
| Bi-CMEC | [EMIM]$BF_4$ | MeCN | 93 ± 7% | Trace | 3.77 ± 0.7 |
| Bi-CMEC | None | MeCN | 49 ± 13% | Trace | 0.11 ± 0.1 |
| Bi-CMEC | [EMIM]$BF_4$ | DMF | 51 ± 7% | Trace | 2.89 ± 0.4 |

[a]Total current density reduction wave (FIG. 4*a*), suggesting that the observed cathodic feature corresponds directly to $CO_2$ reduction.

In order to establish that the electrocatalytic response shown in FIG. 4*a* corresponded to conversion of $CO_2$ to a reduced carbon product, controlled potential electrolysis (CPE) experiments were performed for a $CO_2$ saturated solution of MeCN containing 20 mM $[EMIM]BF_4$ using a Bi-modified GCE (A=−0.07 $cm^2$). After initiating electrolysis at −1.95 V versus SCE, the reaction headspace was periodically analyzed by gas chromatography (GC). This analysis showed that CO was the sole gaseous product formed during the electrolysis experiment. After 60 min, the CPE was discontinued and the amount of CO in the headspace was quantified; the measured CO levels corresponded to a FE of nearly 95% for the $2e^-/2H^+$ conversion of $CO_2$ to CO, with a partial current density of $j_{co}$=3.77±0.7 mA/$cm^2$ (Table 1). Repetition of this experiment under $N_2$ exhibits negligible current density (FIG. 4*b*) and no CO production, indicating that the CO formed under an atmosphere of $CO_2$ is not simply a product of IL or solvent decomposition.

Similarly, repeating this experiment under $CO_2$ but in the absence of $[EMIM]BF_4$ results in a nearly 40-fold decrease in partial current density and a substantial reduction in FE for CO production, as shown in Table 1. Taken together, these control experiments demonstrate that $[EMIM]BF_4$ is integral to the observed electrocatalysis, which is distinguished by high current densities for the selective production of CO over other reduced carbon products or $H_2$.

Figure 4B:
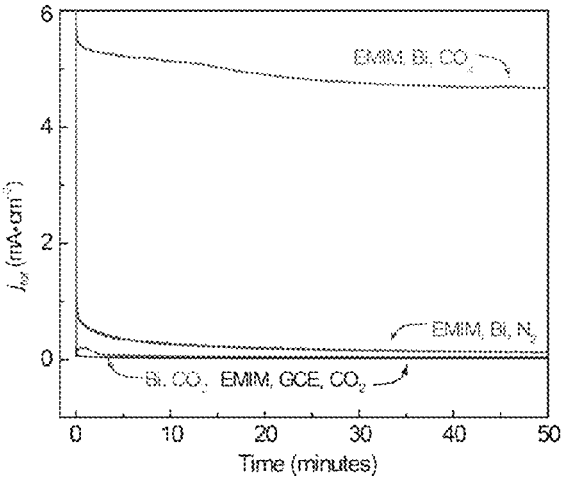

Additional experiments demonstrate that the observed electrocatalysis cannot simply be attributed to homogeneous $CO_2$ reduction mediated by the IL. If the observed electrocatalysis was homogeneous in nature, the identity of the working electrode should have minimal impact on the observed chemistry. Unlike those obtained using a Bi-modified electrode, CV traces recorded for 20 mM $[EMIM]BF_4$ in MeCN under $CO_2$ with a glassy carbon working electrode show virtually no current enhancement upon scanning to negative potentials (FIG. 4*a*). Similarly, CPE of the $CO_2$ saturated solution of MeCN containing $[EMIM]BF_4$ at −1.95 V using a GCE results in negligible charge being passed over the course of a 60 min experiment, and does not produce CO (FIG. 4*b*, Table 1). Accordingly, the Bi-modified electrode is intimately involved in the electrocatalytic conversion of $CO_2$ to CO, and represents the first Bismuth-Carbon Monoxide Evolving Catalyst (Bi-CMEC).

The electrocatalysis observed in MeCN is supported to a lesser extent in DMF. Titration of $[EMIM]BF_4$ into DMF containing 0.1 M $TBAPF_6$ under an atmosphere of $CO_2$ leads to current enhancements that are indicative of electrocatalytic reduction of $CO_2$. The catalytic wave observed for the DMF solution is not as prominent as that observed in MeCN (vide supra). Similarly, CPE of 20 mM solutions of $[EMIM]BF_4$ in DMF results in CO generation with lower efficiency (FE=67%) and reduced current density ($j_{co}$=3.0 mA/$cm^2$) as compared to the same process in MeCN (Table 1). The diminished activity of Bi-CMEC under these conditions may reflect the decreased solubility of $CO_2$ in DMF versus MeCN or a difference in conductivity between the two solvent/electrolyte mixtures.

EXAMPLE 4

The performance of Bi-CMEC on GCE was also assessed using more viscous ILs in MeCN. Titration of either the $BE_4^-$, $PF_6^-$ or triflate ($OTf^-$) salts of 1-butyl-3-methylimidazolium ([BMIM]) into acetonitrile gives rise to electrocatalysis similar to that observed for $[EMIM]BF_4$, as judged by CV. Similarly, CPE of MeCN solutions containing 0.1 M $TBAPF_6$ and 20 mM [BMIM]X (X=$BF_4^-$, $PF_6^-$ or $OTF^-$) at −1.95 V led to the rapid production of CO with near quantitative FEs (Table 2). Notably, the CPEs produced only trace levels of $H_2$ and no detectable formate or oxalate, which are often observed for electrochemical reduction of $CO_2$ in organic solvents.

Figure 5:
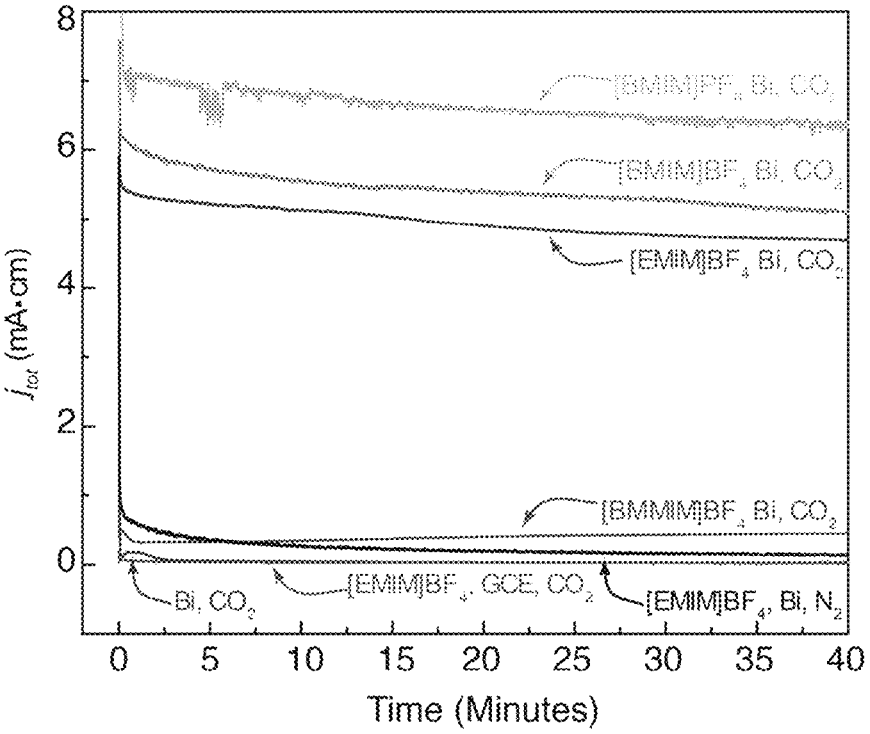
FIG. 5 shows a plot of current density vs. time for bismuth-CMEC on GCE using various ionic liquids.

Electrocatalytic reduction of $CO_2$ by Bi-CMEC in the presence of the [BMIM] ILs generates CO with FEs that are comparable to that observed with [EMIM]. Current densities for CO production ($j_{co}$) using the $[BMIM]^+$ ILs were slightly higher than for the $[EMIM]^+$ experiments (Table 2, FIG. 5) and are similar to those obtained using Ag or Au cathodes. Moreover, the Bi-CMEC system is robust under these conditions and displays steady current densities for CO production over several hours. The energy efficiency of electrocatalytic CO production by Bi-CMEC can be calculated using the expression below (Eq. 5), in which $E^o$ $CO_2/CO$ represents the standard reduction potential for conversion of $CO_2$ to CO under a given set of conditions and E is the applied potential. Determination of the energy efficiency of the Bi-CMEC system requires an estimation of the standard potential of the $CO_2/CO$ redox couple ($E^o$ $CO_2/CO$) and calculation of the overpotential (η) at which CPE is carried out. The position of $E^o$ $CO_2/CO$ in MeCN is dependent on the proton donating ability of the electrolyte solution.

$$\text{Energy Efficiency}(\Phi_{CO})=[FE\times E^o_{CO2/CO}]/E \quad \text{(Eq. 5)}$$

In the present system, the $[EMIM]^+$ and $[BMIM]^+$ ILs are the most likely proton donors, with pKa values in MeCN of approximately 32. As such, proton availability is low under the electrolysis conditions described above, which drives $E^o$ $CO_2/CO$ to more negative potential. For the imidazolium ILs employed in this study, the standard $E^o$ $CO_2/CO$ redox couple can be estimated to be −1.78 V versus SCE. Given that Bi-CMEC drives selective CO formation while operating with appreciable current density at E=−1.95 V, the overpotential for this process is only 0.165 V. The low overpotential coupled with the high FE displayed by this system corresponds to an energy efficiency of over 85%. Both the low overpotential and high energy efficiency distinguish Bi-CMEC as a promising platform for electrocatalytic CO production, as both these values compare favorably

TABLE 2

Faradaic efficiencies (FE) and current densities for electrocatalytic reduction of $CO_2$ to CO at an applied potential of −1.95 V vs. SCE.

| Electrode | Ionic Liquid | Solvent | CO FE | $H_2$ FE | $j_{co}$ (mA/$cm^2$) |
|---|---|---|---|---|---|
| Bi-CMEC | $[EMIM][BF_4]$ | MeCN | 93 ± 7% | Trace | 3.77 ± 0.7 |
| Bi-CMEC | $[BMIM][BF_4]$ | MeCN | 90 ± 9% | Trace | 5.51 ± 1.2 |
| Bi-CMEC | [BMIM][PF6] | MeCN | 95 ± 6% | Trace | 4.82 ± 0.7 |
| Bi-CMEC | $[BMMIM][BF_4]$ | MeCN | 77 ± 8% | Trace | 0.67 ± 0.5 |

to those obtained using Ag and Au based electrocatalysts. These noble-metal cathodes are among the most efficient existing platforms for electrolytic generation of CO from $CO_2$ but the implementation of these systems is seriously impeded by their prohibitive cost. That Bi-CMEC can be prepared at a very small fraction of the cost of these existing systems may represent an important step toward development of a scalable system for the renewable production of carbon-based fuels.

Figure 6:
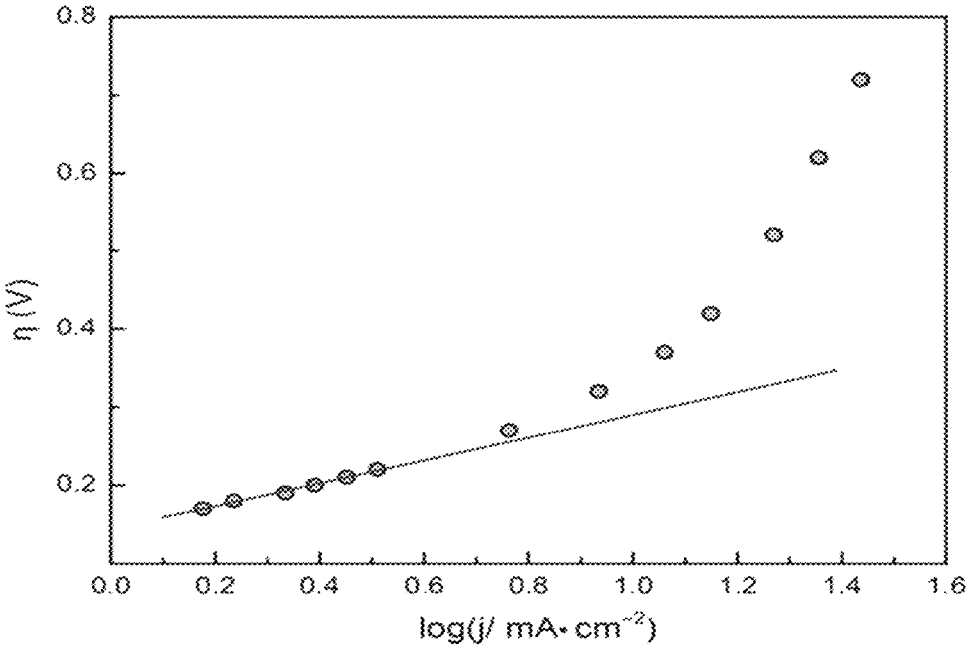
FIG. 6 shows a Tafel plot for bismuth-CMEC on GCE.

The variation in partial current density for CO for Bi-CMEC on glassy carbon was measured as a function of applied overpotential in $CO_2$ saturated MeCN containing 20 mM [BMIM]PF6. These data were obtained by performing stepped-potential electrolyses between E=−1.95 and −2.5 V, with commensurate quantification of the gaseous products by GC. The FE for CO production remains high as the applied η is increased, however the resulting Tafel plot constructed from these data (FIG. 6) begins to deviate from linearity as the applied potential exceeds −2.1 V. This curvature may be due to uncompensated iR drop caused by the surface resistivity of the GCE. The Tafel data is linear in the range of η=0.165-0.275 V, with a slope of 139 mV/decade. The observed slope, which is close to 118 mV/dec, supports a mechanistic pathway in which initial electron transfer to generate a surface adsorbed $CO_2^{\bullet-}$ pecies is rate determining. This is a mechanism that has been invoked for reduction of $CO_2$ at many heterogeneous electrodes.

EXAMPLE 5

The performance of Bi-CMEC on GCE was also assessed using $[BMIM]^+$ based ILs in MeCN without tetrabutylammonium hexafluorophospate. Titration of either the $Cl^-$, $Br^-$ $BF_4^-$, $PF_6^-$ or triflate ($OTf^-$) salts of $[BMIM]^+$ into acetonitrile gives rise to an electrocatalysis similar to that observed for that described in the above example, as judged by CV. Similarly, CPE of MeCN solutions containing 100-300 mM [BMIM]X (X=$Cl^-$, $Br^-$, $BF_4^-$, $PF_6^-$ or $OTF^-$) at −1.95 V led to the rapid production of CO with near quantitative FEs (Table 3). Notably, the CPEs produced only trace levels of $H_2$ and no detectable formate or oxalate, which are often observed for electrochemical reduction of $CO_2$ in organic solvents.

Electrocatalytic reduction of $CO_2$ by Bi-CMEC in the presence of the 100-300 mM [BMIM]X solutions generates CO with FEs that are comparable to that observed in the presence of $TBAPF_6$, along with attendant current densities for CO production ($j_{co}$) that can be as high as 30 mA/cm$^2$ (Table 3) at an applied potential of −2.0 V vs. SCE. These high current densities are significantly larger than those typically obtained using Ag or Au cathodes. Moreover, the Bi-CMEC system is robust under these conditions and displays steady current densities for CO production over several hours for each IL probed, suggesting that Bi-CMEC is neither passivated nor degraded by any of the anions surveyed.

While selectivity and current density are important metrics by which any electrocatalyst is judged, energy conversion efficiency is also a critical parameter in benchmarking electrocatalyst platforms for renewable energy storage and/or fuel synthesis.

TABLE 3

Faradaic efficiencies (FE) and current densities for electrocatalytic reduction of $CO_2$ to CO at an applied potential of −2.0 V vs. SCE in the presence of 300 mM IL.

| Electrode | Ionic Liquid | Solvent | CO FE | $\Phi_{CO}$ | $j_{co}$ (mA/cm$^2$) |
|---|---|---|---|---|---|
| Bi-CMEC | $[BMIM]PF_6$ | MeCN | 82 ± 12% | 73% | 31 ± 2 |
| Bi-CMEC | $[BMIM]BF_4$ | MeCN | 82 ± 11% | 73% | 26 ± 4 |
| Bi-CMEC | [BMIM]Cl | MeCN | 79 ± 12% | 70% | 17 ± 2 |
| Bi-CMEC | [BMIM]Br | MeCN | 74 ± 4% | 65% | 20 ± 1 |
| Bi-CMEC | [BMIM]OTf | MeCN | 87 ± 8% | 77% | 25 ± 2 |

The energy efficiency with which Bi-CMEC drives the electrocatalytic production of CO from $CO_2$ can be determined by considering the FE for CO formation, the standard potential of the $CO_2$/CO redox couple under the CPE conditions ($E^o_{CO2/CO}$) and calculation of the overpotential (η) at which CPE is carried out, as highlighted above by Eq. 5. With these values in hand, the energy efficiency ($\Phi_{CO}$) of electrocatalytic CO production by Bi-CMEC in the presence of each of the imidazolium promoters listed in Table 3 is calculated to approach 80%. Except for the case of [BMIM]Br, which shows the lowest FE for CO production, each of the ILs studied promotes the conversion of $CO_2$ to fuel with energy efficiencies ($\Phi_{CO}$) that are above 70%.

EXAMPLE 6

The electrocatalytic reduction of $CO_2$ offers a promising route to the conversion of renewable sources of electric current to carbon based fuels when coupled to the $4e^-/4H^+$ splitting of water. A two-compartment cell for $CO_2$ electrocatalysis allowed CO production at the Bi-CMEC modified electrode to be coupled to water oxidation. In these experiments, the anode compartment consisted of a piece of platinum-gauze in aqueous phosphate buffer (pH ~7.4) and the cathode compartment was comprised of the Bi-CMEC modified GCE immersed in $CO_2$ saturated MeCN containing 0.1M $TBAPF_6$ and 20 mM $[BMIM]PF_6$. The two compartments were separated by a Nafion® membrane. CV analysis of this split cell arrangement shows the same intense catalytic wave for $CO_2$ reduction at approximately −1.9 V (FIG. 6) that was observed using the single solvent arrangement (vide supra).

Figure 7:
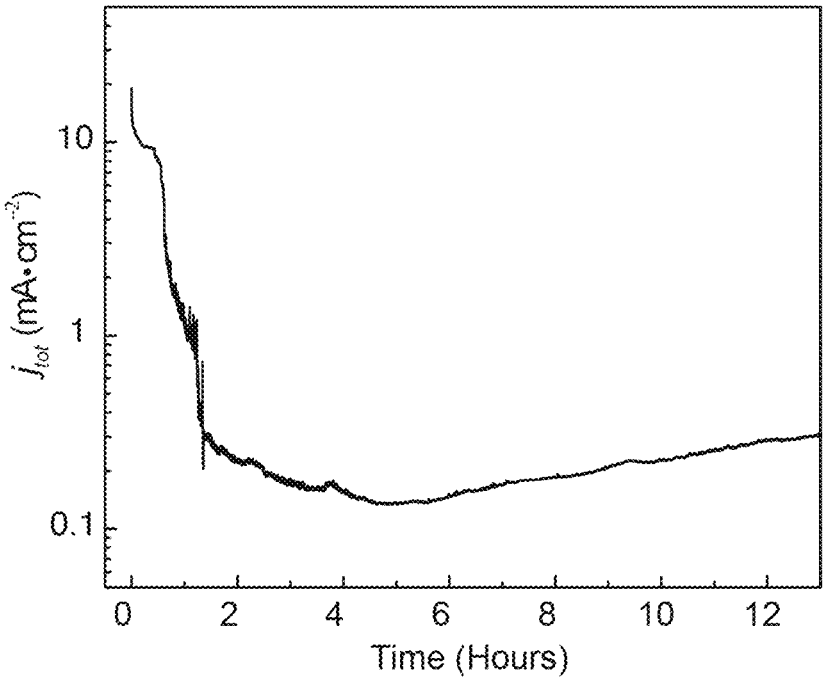
FIG. 7 shows a plot of current density vs. time for bismuth-CMEC on GCE using a split electrode/electrolyte arrangement.

CPE experiments using the split electrode/electrolyte arrangement showed initial current densities of approximately 9 mA/cm$^2$ with a FE of 52% for generation of CO (FIG. 7). Together, these data correspond to a TOF of approximately 300 $s^{-1}$. Permeation of the Nafion® membrane by water caused a decrease in electrocatalytic CO evolution activity, which ultimately plateaued to $j_{tot}$=0.2 mA/cm$^2$ with a FE of 39% for CO formation. The Bi-CMEC assembly is robust under these conditions as extended CPEs of over 12 hours showed no additional decay in current density over time. Based on the electrochemical surface area of the Bi-CMEC electrode, the charge passed during the experiment corresponds to over 250,000 turnovers over the course of the 12 hour electrolysis.

TOF is roughly an order of magnitude lower than that obtained when using the single cell arrangement, likely due to losses across the membrane, rather than an intrinsic incompatibility of the Bi-CMEC platform with the split cell system. As such, it is expected that improved mass transport using a flow-cell, gas diffusion electrode or other advanced cell design would enable higher current densities for CO production while maintaining high energy efficiency. Additional improvements in activity may also be attained simply by improving ohmic contact between the Bi-CMEC and underlying GCE or by using an alternative substrate entirely. We note, however that this lowered current density is still in line with those observed using other heterogeneous $CO_2$ reduction catalysts under ambient conditions.

While this invention has been described in terms of several preferred embodiments, there are alterations, permutations, and substitute equivalents, which fall within the scope of this invention. It should also be noted that there are many alternative ways of implementing the methods and apparatuses of the present invention. It is therefore intended that the following appended claims be interpreted as including all such alterations, permutations, and substitute equivalents as fall within the true spirit and scope of the present invention.

What is claimed is:

1. A method for electrochemically converting carbon dioxide to carbon monoxide, wherein the method comprises electrolyzing carbon dioxide in an electrolytic system comprising an electrode comprised of bismuth and a source of electrical current in electrical communication with the electrode.

2. The method of claim 1, further comprising continuously streaming carbon dioxide into the electrolytic system.

3. The method of claim 1, wherein the electrode comprised of bismuth is a cathode and the electrolytic system further comprises an anode and an electrolyte in fluid communication with at least one of the cathode comprised of bismuth or the anode.

4. The method of claim 3, wherein the electrolyte is an ionic liquid comprising at least one of borate ions, phosphate ions, bistriflimide, triflate, tosylate, hexafluorophosphate ions, tetrafluoroborate ions, chloride ions, bromide ions, carboxylate ions, imidazolium ions, pyridin urn ions, pyrrolidinium ions, ammonium ions, phosphonium ions, halides and combinations thereof.

5. The method of claim 4, wherein the ionic liquid comprises one or more 1,3-disubstituted imidazolium salts.

6. The method of claim 3, wherein the electrolyte is an organic electrolyte comprising one of acetonitrile, dimethylformamide, dimethyl suifoxide, carbonates, and combinations thereof.

7. The method of claim 3, wherein the cathode is in fluid communication with a first electrolyte, the anode is in fluid communication with a second electrolyte, and the first electrolyte and the second electrolyte are the same as or different from each other.

8. The method of claim 3, wherein the cathode is a conducting bismuth or bismuth film cathode and the anode is a platinized anode or a metal oxide anode.

9. The method of claim 3, wherein the anode is comprised of platinum.

10. The method of claim 1, wherein the electrode comprised of bismuth has been made by a method comprising electrodepositing a bismuth containing material onto a surface of an inert electrode substrate from either an aqueous, organic or mixed aqueous/organic solution.

11. The method of claim 10, wherein the method of making the electrode comprised of bismuth further comprises reducing a solution comprising a precursor to the bismuth containing material and wherein the inert electrode substrate is a carbon or metal-based electrode.

* * * * *